US005421735A

United States Patent [19]

Dechelette

[11] Patent Number: 5,421,735

[45] Date of Patent: Jun. 6, 1995

[54] MODULAR COAXIAL CABLE CONNECTOR

[75] Inventor: Helen Dechelette, Wissous, France

[73] Assignee: Molex Incorporated, Lisle, Ill.

[21] Appl. No.: 162,728

[22] Filed: Dec. 3, 1993

[30] Foreign Application Priority Data

Jan. 21, 1993 [EP] European Pat. Off. ..... 93100839

[51] Int. Cl.[6] ..... H01R 4/24; H01R 13/514

[52] U.S. Cl. ..... 439/101; 439/394; 439/701

[58] Field of Search ..... 439/101, 394, 695, 701

[56] References Cited

U.S. PATENT DOCUMENTS

| | | | |
|---|---|---|---|
| 3,587,028 | 6/1971 | Uberbecher | 439/101 |
| 4,046,452 | 9/1977 | Cassarly | 439/701 X |
| 4,611,867 | 9/1986 | Ichimura et al. | 439/608 |
| 4,632,486 | 12/1986 | Hasircoglu | 439/394 |
| 4,997,386 | 3/1991 | Kawachi | 439/701 X |
| 5,116,230 | 5/1992 | Dechelette | 439/101 |

FOREIGN PATENT DOCUMENTS

| | | |
|---|---|---|
| 2124041 | 2/1984 | United Kingdom . |
| 1109914 | 4/1988 | United Kingdom . |

*Primary Examiner*—Kenneth J. Ramsey

*Attorney, Agent, or Firm*—A. A. Tirva

[57] ABSTRACT

An electrical connector assembly is disclosed for terminating a shielded insulated cable (88) having a conductor core (90) with a sheath (92) of insulation therearound, an outer insulating jacket (94) and a shield (96) between the sheath and the jacket. The connector assembly includes a connector housing (64) having a receptacle cavity (66). A preassembled module (58) is adapted to be received in the cavity. The module includes a dielectric insert housing (14) having a terminal-receiving passage (38). An electrically conductive signal terminal (56) is mounted in the passage for termination to the conductor core of the cable. An electrically conductive grounding terminal (12) is mounted on the outside of the insert housing for termination to the shield of the cable. Therefore, the insert housing (14), the signal terminal (56) and the grounding terminal (12) can be preassembled as a module (58) and inserted as a modular unit into the receptacle cavity in the connector housing. The grounding terminal and signal terminal include deformable wall portions (34,60) for termination to the shield (96) and the conductor core (90), respectively, of the cable in response to application of forces generally parallel to the longitudinal axis (A) of the cable (88).

11 Claims, 6 Drawing Sheets

MODULAR COAXIAL CABLE CONNECTOR

FIELD OF THE INVENTION

This invention generally relates to the art of electrical connectors and, particularly, to a shielding and grounding connector assembly, such as for use with coaxial cables, and specifically to such a connector having a grounding contact/shielding contact module.

BACKGROUND OF THE INVENTION

Shielded insulated wires or coaxial cables have a conductor core with a sheath of insulation therearound, an outer insulating jacket and a shield means, such as a braid or foil, between the sheath and the jacket. Coaxial cables of the character described are becoming increasingly miniaturized and commonly are termed "microcoaxial" cables and are used for high speed signal applications. For instance, a 50 ohm microcoaxial cable may have an outside diameter on the order of 1.9 mm which can be terminated on a 2.5 mm pitch either in a single row or a multi-row configuration. Contacts terminated to the ores of such cables are mated to compliant pins fixed in a plane of a 2.5 mm grid array.

Such microcoaxial cable and connector systems are available with the cables terminated to their respective contacts by crimping or soldering termination techniques. A problem with such techniques is that they require considerable time in preparing the cables, such as exposing the braided or foil shield means, as well as terminating the cables to their respective contacts. Termination tooling for such applications normally require several tools to carry out the completed terminating and grounding operations. Other problems involve discrepancies between the electrical potential between separate cable/contacts, and "crosstalk" may occur between any members of a multi-cable system at different electrical potentials.

A solution to the above problems is disclosed in U.S. Pat. No. 5,166,230 to Dechelette et al., dated May 26, 1992, assigned to the assignee of this invention and which is incorporated herein by reference. That patent shows a connector assembly which eliminates crimping or soldering termination techniques, which requires less cable preparation than prior art techniques, which requires much simpler application tooling, and which substantially reduces crosstalk. The connector assembly therein includes conductive grounding terminal means having piercing means for displacing the outer insulating jacket of the coaxial cable upon application of a force on the grounding terminal means generally parallel to the longitudinal axis of the cable. A signal terminal has at least one deflectable wall portion which is terminated to the conductor core also upon application of a force directed generally parallel to the longitudinal axis of the cable.

The present invention is directed to further improvements in electrical connector assemblies of the character described above by providing a preassembled module which includes both the conductive grounding terminal means and the signal terminal assembled as a module and inserted into a connector housing as a modular unit which further reduces the time and manual operations required in assembling the connector.

SUMMARY OF THE INVENTION

An object, therefore, of the invention is to provide a new and improved electrical connector assembly for terminating a shielded insulated cable with improved efficiency.

As is known, a coaxial cable includes a conductor core with a sheath of insulation therearound, an outer insulating jacket and a shield means, such as a braid or foil, between the sheath and the jacket. The invention is directed to a connector assembly for terminating such a coaxial cable. The connector assembly includes a connector housing having a receptacle cavity.

The invention contemplates the provision of a preassembled module adapted to be received in the receptacle cavity of the connector housing and including a dielectric insert housing having a terminal-receiving passage, with an electrically conductive signal terminal mounted in the passage for termination to the conductor core of the cable. An electrically conductive grounding terminal is mounted on the outside of the insert housing for termination to the shield means of the cable. Therefore, the preassembled insert housing, signal terminal and grounding terminal can be assembled as a module and inserted as a modular unit into the receptacle cavity of the connector housing.

In the exemplary embodiment of the invention, the grounding terminal includes piercing means for displacing the outer insulating jacket of the cable. The piercing means are configured and structured to displace the insulating jacket upon application of a force on the grounding terminal generally parallel to the longitudinal axis of the cable. The signal terminal has at least one deflectable wall portion for displacement into terminating engagement with the conductor core upon application of a force directed generally parallel to the longitudinal axis of the cable. Therefore, the cable can be both grounded and terminated in response to application of those forces. As disclosed herein, the connector housing may include a plurality of the receptacle cavities, or an enlarged multimodule cavity, and it is contemplated that a plurality of the preassembled modules be adapted to be received in respective ones of the individual cavities of side-by-side in the enlarged cavity.

Other features of the invention include complementary interengaging locking means between the insert housing and the grounding terminal to retain the grounding terminal on the insert housing in preassembled condition. Specifically, the insert housing is generally rectangular in configuration, as defined by first opposite side walls and second opposite side walls. The grounding terminal includes spring contact portions outside the first opposite side walls and rigid portions outside the second opposite side walls. The complementary interengaging locking means are provided between the grounding terminal and the first opposite side walls of the housing. The connector assembly includes a cover for closing the receptacle cavity in the connector housing, and the rigid portions of the grounding terminal include locking tabs for interengagement with the cover. The rigid portions of the grounding terminal also include rigidifying ribs extending generally parallel to the longitudinal axis of the cable for accepting the application of forces thereon to displace the outer insulating jacket of the cable.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
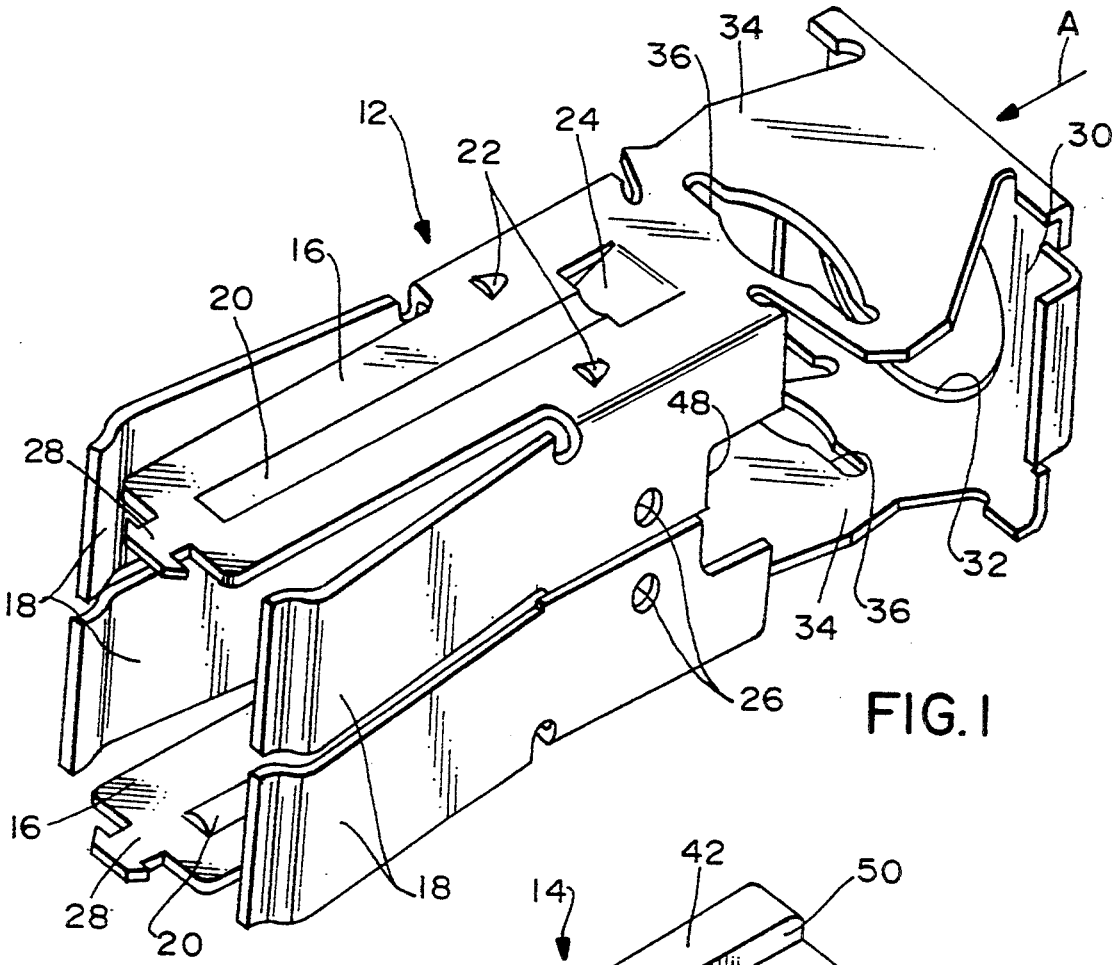
FIG. 1 is a perspective view of the grounding terminal of the preassembled module of the invention.

Referring to the drawings in greater detail, and first to FIGS. 1 and 2, the invention generally contemplates a preassembled module adapted to be received in a receptacle cavity of a connector housing of an electrical connector assembly, as will be described in greater detail hereinafter. The module includes an electrically conductive grounding terminal, generally designated 12 in FIG. 1, which is mounted about the outside of a modular insert housing, generally designated 14 in FIG. 2. As will be explained hereinafter, the grounding terminal terminates a shield means of a coaxial cable, and the insert housing mounts an electrically conductive signal terminal for termination to a conductor core of the cable. It can be seen that the grounding terminal and the insert housing are elongated and generally rectangular in overall configuration.

Specifically, grounding terminal 12 (FIG. 1) includes a rectangular box-like body defined by rigid wall portions 16 on two sides of the terminal and two pairs of spring contact portions 18 on the opposite to sides of the terminal. This box-like body is sized and configured for substantially surrounding insert housing 14 (FIG. 2). The entire grounding terminal preferably is stamped and formed from sheet metal material. Each rigid side wall portion 16 of the grounding terminal includes a longitudinally extending rib 20 formed in the sheet metal thereof to facilitate rigidifying the rigid wall portion in its longitudinal direction. Retaining notches 22 are formed on opposite sides of rib 20, and the rib terminates at a stop finger 24 bent inwardly of the box-like body portion of the terminal. A pair of locking holes 26 are formed in the opposite sides of the terminal inwardly of spring contact portions 18 for locking the grounding terminal to insert housing 14 (FIG. 2) as will be described hereinafter. The distal ends of rigid side wall portions 16 are provided with locking teeth 28 for interengagement with a cover of the main electrical connector assembly, as will be described hereinafter.

Still referring to FIG. 1, grounding terminal 12 includes an end wall 30 having a circular hole 32 for insertion thereinto of a coaxial cable in the direction of arrow "A". In essence, the arrow defines the longitudinal axis of the cable.

Generally, grounding terminal 12 includes piercing means for displacing the outer insulating jacket of the cable upon application of an axial force on the grounding terminal generally parallel to longitudinal axis "A" of the cable. Specifically, a pair of opposing deflectable walls 34 are formed inwardly in a generally V-shaped configuration inwardly of end wall 30. Insulation piercing slots 36 are formed in the deflectable walls along the inner crest or apex of the V-shaped configuration of the deflectable walls. Therefore, upon the application of an axial force on the grounding terminal, the deflectable walls 34 will deflect inwardly and the edges of slots 36 will cut through the outer insulating jacket of the cable which has been inserted through hole 32, again as will be apparent hereinafter.

Figure 2:
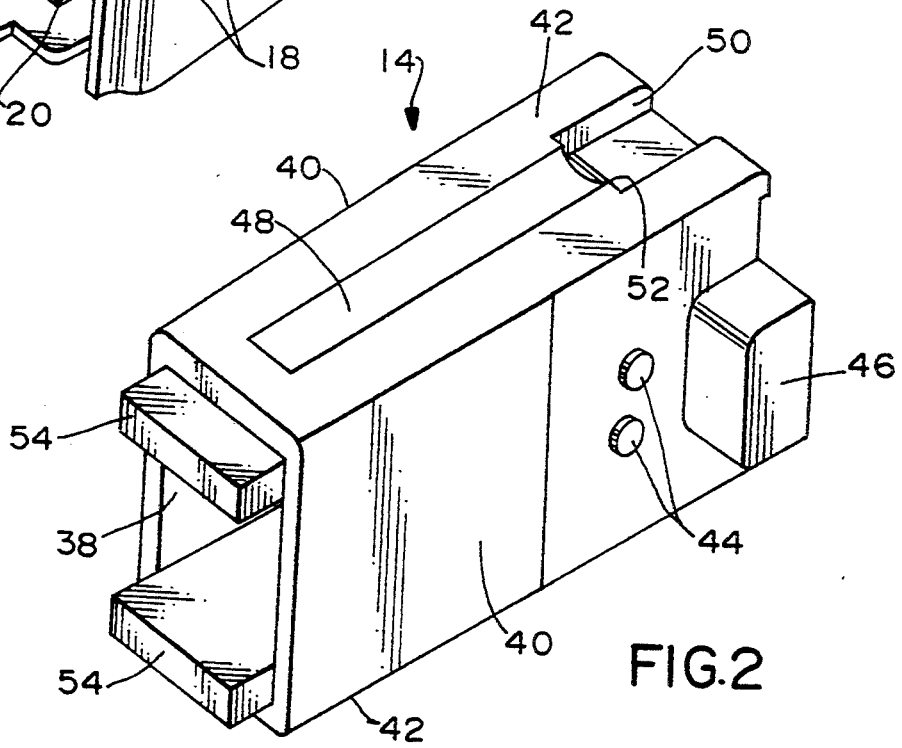
FIG. 2 is a perspective view of the insert housing of the module.

Referring to FIG. 2, insert housing 14 includes a terminal-receiving passage 38 extending therethrough. The housing is elongated and generally rectangular in cross-section, including first opposite side walls 40 against which spring contact portions 18 of ground terminal 12 (FIG. 1) are juxtaposed, along with second opposite side walls 42 against which rigid walls 16 of the grounding terminal are juxtaposed. The insert housing is unitarily molded of dielectric material, such as plastic or the like, and side walls 40 each have a pair of locking bosses 44 projecting outwardly therefrom and adapted to be received in locking holes 26 on opposite sides of grounding terminal 12. An enlarged boss 46 is adapted to be received within an enlarged notch 48 (FIG. 1) of the grounding terminal. Second side walls 42 of insert housing 14 include longitudinally molded troughs 48 for accommodating rigidifying ribs 20 of the grounding terminal, along with recesses 50 into which stop fingers 24 of the grounding terminal project. Recesses 50 include stop shoulders 52 against which stop fingers 24 abut, for purposes described hereinafter Lastly, insert housing 14 includes a pair of pusher portions 54 projecting from the outer distal end thereof for engagement by a cover (described hereinafter) of the electrical connector assembly which, in turn, effects axial termination of the entire module.

Figure 3:
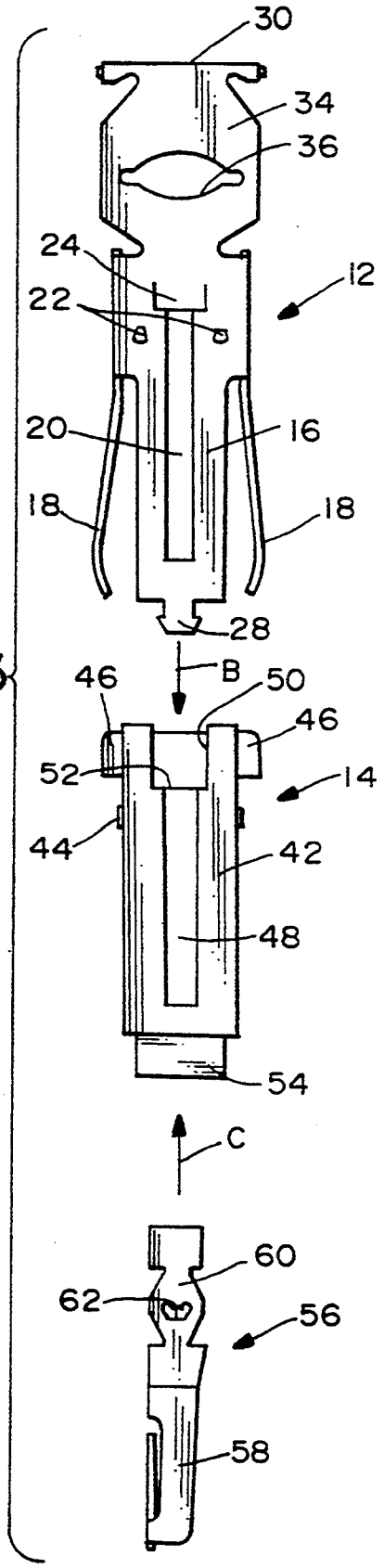
FIG. 3 is an exploded elevational view of the grounding terminal, the insert housing and a signal contact insertable into the housing.
Figure 4:
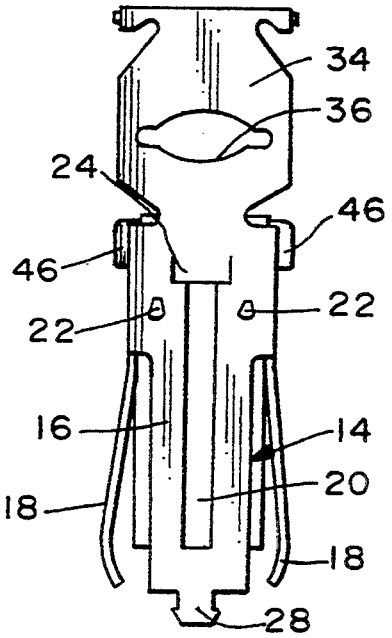
FIG. 4 is an elevational view of the module in assembled condition.

FIG. 3 shows grounding terminal 12 in conjunction with insert housing 14, and also in conjunction with an electrically conductive signal terminal 56. These three components are preassembled into a module, generally designated 58 in FIG. 4. Grounding terminal 12 is assembled about the outside of insert housing 14 in the direction of arrow "B" (FIG. 3). Either before or after the grounding terminal is assembled about the insert housing, signal terminal 56 is inserted into passage 38 (FIG. 2) in the direction of arrow "C" (FIG. 3). As shown, the signal terminal is a female terminal and includes a contact receptacle end 58 into which an appropriate mating terminal pin of a complementary connector (not shown) can be inserted. The signal terminal also includes at least one deflectable wall portion 60 having a termination slot 62 constructed similarly to deflectable walls 34 and insulation piercing slots 36 of grounding terminal 12. In other words, the deflectable wall portion 60 of the signal terminal is displaceable inwardly into terminating engagement with the core of the coaxial cable upon application of a force directed generally parallel to the longitudinal axis of the cable, again as described hereafter. Therefore, the cable can be both grounded and terminated in response to application of those axial forces.

Figure 5:
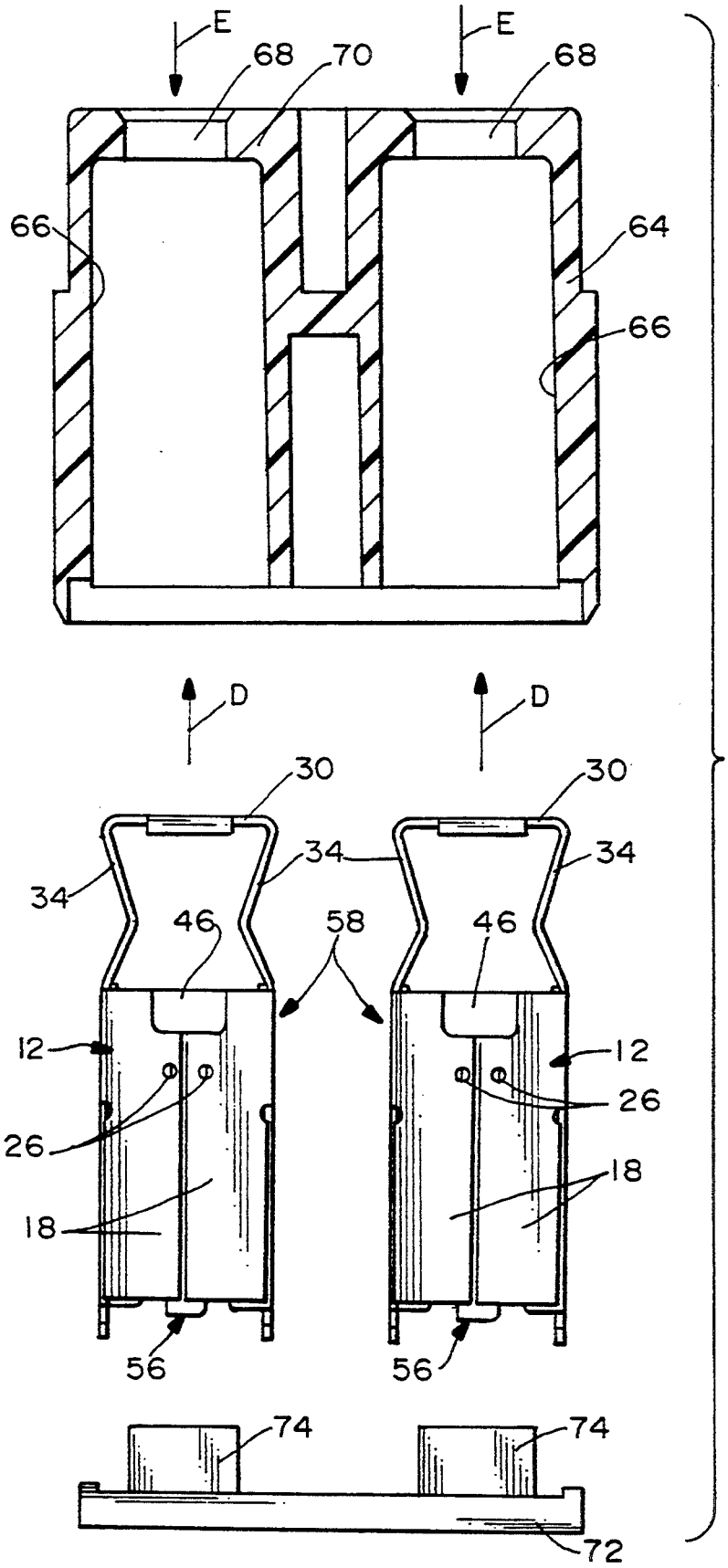
FIG. 5 is an exploded elevational view of a pair of the modules in conjunction with components of a complete electrical connector assembly, with the connector housing in section.
Figure 6:
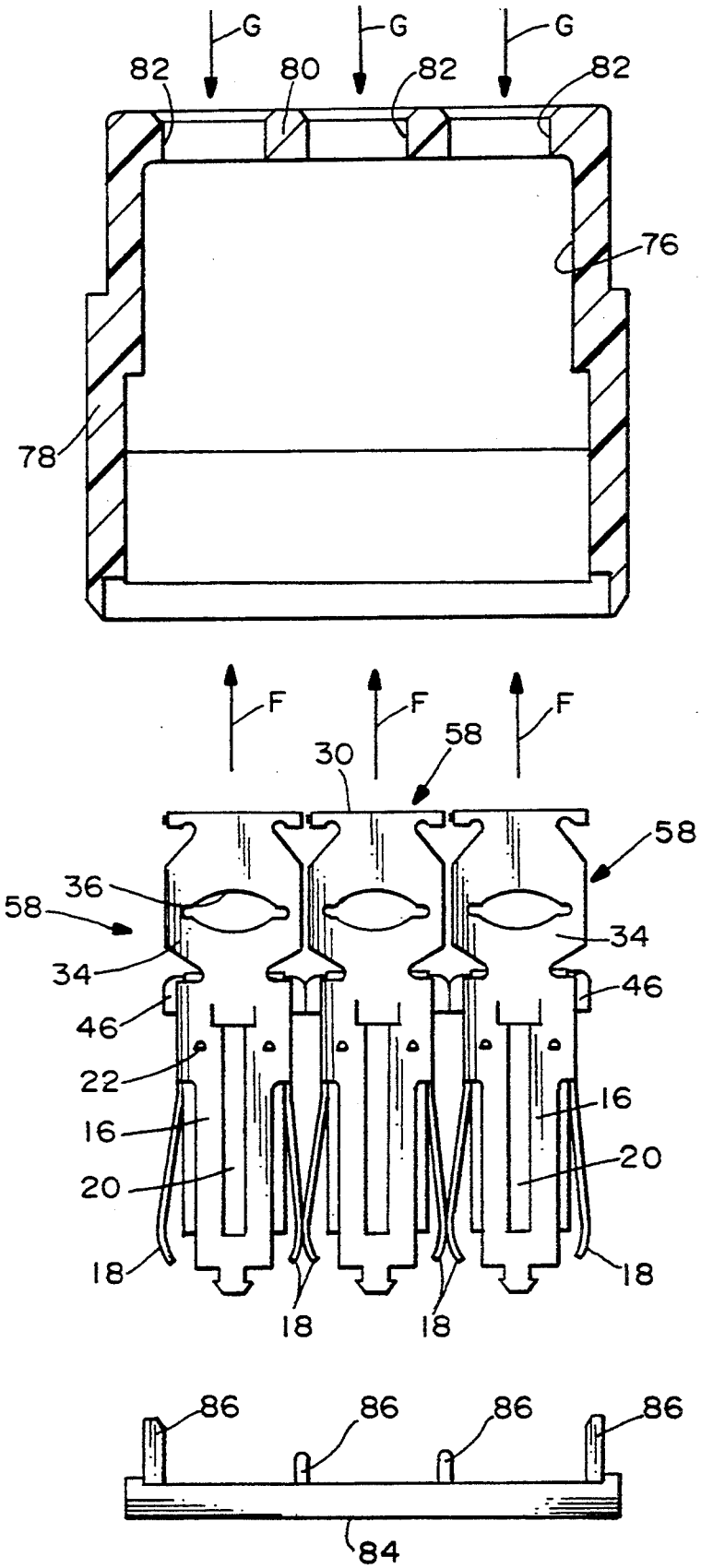
FIG. 6 is a view similar to that of FIG. 5, with the connector assembly including three modules, and again with the connector housing in section.

FIGS. 5 and 6 show, somewhat generally, two applications of a wide variety of applications for employing one or more modules 58 (FIG. 4) in various electrical connector assemblies. Specifically, FIG. 5 shows an electrical connector housing 64 having a pair of receptacle cavities 66 isolated from each other. The cavities are adapted to receive a pair of modules 58 inserted into the cavities in the direction of arrows "D". It should be noted that an aperture 68 is formed in one end wall 70 of the housing for each cavity 66. The apertures are provided for insertion thereinto, in the direction of arrows "E" of a pair of coaxial cables. The apertures are in alignment with cable insertion holes 32 (FIG. 1) in end walls 30 of grounding terminals 12 of modules 58. A cover 72 is adapted for closing the opposite end of housing 64 and thereby closing cavities 66. The cover includes protrusions 74 for preloading the grounding terminals. In the electrical connector assembly of FIG. 5, housing 64 may be molded of dielectric material such as plastic or the like, and cover 72 may be similarly fabricated. In such an application, the grounding terminals of modules 58 are insulatingly isolated from each other.

FIG. 6 shows an electrical connector application for the modules of the invention, wherein three modules 58 are inserted into a single enlarged, or common receptacle cavity 76 of a housing 78, in the direction of arrows "F". Receptacle cavity 76 is sized and configured for receiving three modules 58 in close juxtaposition, as shown. Like the connector assembly of FIG. 5, one end wall 80 of housing 78 is provided with three apertures 82 for insertion thereinto of three coaxial cables in the direction of arrows "G". Again, apertures 82 are aligned with the cable-receiving holes 32 (FIG. 1) of the grounding terminals of the modules. A cover 84 is adapted to close cavity 76 and the cover again includes projections 86 for preloading the grounding terminals of the modules.

With the connector application as illustrated in FIG. 6, housing 78 may be fabricated of conductive material, such as metal, to provide a common ground throughout the entire assembly. To that end, it can be seen that modules 58 are oriented 90° relative to modules 58 in FIG. 5. In the orientation of the modules in FIG. 6, it can be seen that spring contact portions 18 of the grounding terminals of the modules, as well as the conductive housing, provide commoning of the grounding means throughout the entire connector assembly.

Figure 7:
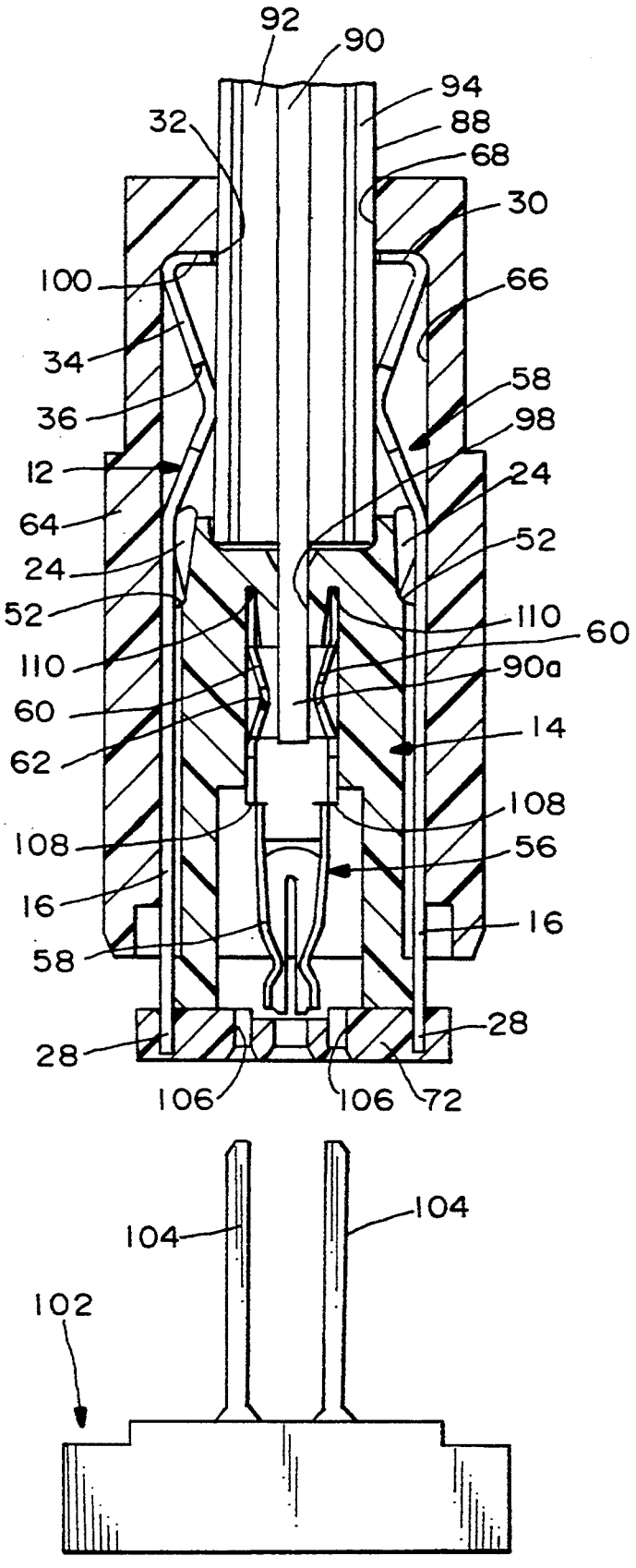
FIG. 7 is an axial section through one of the connector assemblies, showing the module prior to termination to a cable, and in conjunction with a terminating tool.
Figure 8:
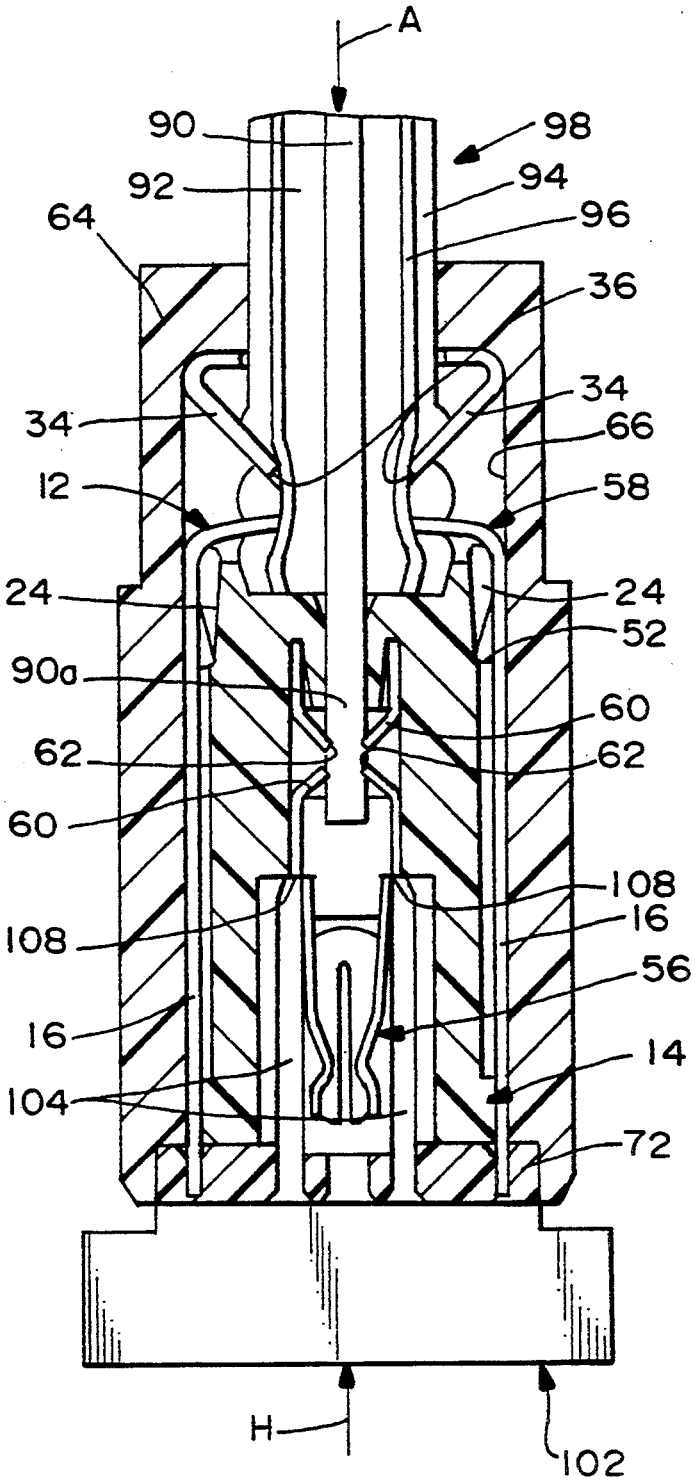
FIG. 8 is a view similar to that of of FIG. 7, but with the tool terminating the module to the cable within the connector housing.

FIGS. 7 and 8 show an application wherein a single module 58 is mounted within one of the receptacle cavities 66 of housing 64 (FIG. 5). It can be seen that a coaxial cable, generally designated 88, has been inserted through one of the apertures 68 in connector housing 64 and through hole 32 in end wall 30 of grounding terminal 12 of the preassembled module. As is conventional, the coaxial cable is a shielded cable and includes a conductor core 90 with a sheath of insulation 92 therearound, an outer insulating jacket 94, and a shield means 96 sandwiched between the sheath and the jacket. The shield means may be a conventional braid or foil. It also can be seen that a length or distal end **90*a* of the conductor core has been stripped of the sheath, the shield and the jacket, and the core projects through an axial bore 98 in insert housing 14. It should be noted that stripped distal end 90*a* of the conductor core is inserted into alignment with deflectable wall portions 60 of signal terminal 56, while the unstripped cable is in alignment with deformable walls 34 and insulation piercing slots 36 of grounding terminal 58**.

FIG. 7 shows preassembled module 58 prior to termination with coaxial cable 88. In this condition, end wall 30 of grounding terminal 12 abuts against an inside wall 100 of connector housing 64. Cover 72 is in engagement with the outer distal ends of rigid wall portions 16 of the grounding terminal, with teeth 28 engaged within the cover. A terminating tool, generally designated 102, includes a pair of pusher prongs 104 insertable through a pair of holes 106 in cover 72. The pusher prongs are engageable with a pair of shoulders 108 on the outside of signal terminal 56, with the signal terminal abutting or bottoming-out within insert housing 14, as at 110. It also can be seen that stop fingers 24 of the grounding terminal are in abutment with stop shoulders 52 on the outside of insert housing 14.

Now, turning to FIG. 8, it can be seen that terminating tool 102 has been moved into engagement with cover 72 in the direction of arrow "H" and pusher prongs 104 of the terminating tool are in engagement with shoulders 108 of signal terminal 56. When the terminating tool is forced axially in the direction of arrow "H" (i.e. generally parallel to the longitudinal axis "A" of coaxial cable 88), pusher prongs 104 are effective to deform or collapse deflectable wall portions 60 of the signal terminal, whereby slots 62 are deflected into terminating engagement with stripped end **90*a* of the conductor core of the cable. Simultaneously, application of the axial force by terminating tool 102 is effective to deflect deformable walls 34 of grounding terminal 12, whereupon insulation piercing slots 36 displace outer insulating jacket 94 of the cable for establishing conductivity with or termination to shield 96 of the cable. The forces of the terminating tool on the grounding terminal are transmitted through cover 72 and rigid wall portions 16 of the grounding terminal, as well as through the cover and insert housing 14 to the grounding terminal, through stop fingers 24 and abutting stop shoulders 52 of the insert housing. Therefore, the signal terminal and the grounding terminal of the preassembled module are terminated simultaneously in response to the application of the axial forces by terminating tool 102. A plurality of the modules can be mass or gang terminated, such as in the multi-module applications illustrated in FIGS. 5 and 6**.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector assembly for terminating a shielded insulated cable having a conductor core with a sheath of insulation therearound, an outer insulating jacket and a shield means between the sheath and the jacket, the assembly including a connector housing having a receptacle cavity, wherein the improvement comprises a preassembled module adapted to be received in the cavity and including a dielectric insert housing having a terminal-receiving passage, an electrically conductive signal terminal mounted in the passage for termination to the conductor core of the cable, and an electrically conductive grounding terminal mounted on the outside of the insert housing for termination to the shield means of the cable, whereby the insert housing, signal terminal and grounding terminal can be preassembled as a module and inserted as a modular unit into the receptacle cavity in the connector housing and wherein the connector housing includes an enlarged receptacle cavity for receiving a plurality of said preassembled modules with the grounding terminals of adjacent modules in engagement.

2. In an electrical connector assembly as set forth in claim 1, wherein said grounding terminal includes piercing means for displacing the outer insulating jacket of the cable.

3. In an electrical connector assembly as set forth in claim 2, wherein said piercing means is configured and structured to displace the insulating jacket upon application of a force on the grounding terminal generally parallel to the longitudinal axis of the cable.

4. In an electrical connector assembly as set forth in claim 3, wherein said signal terminal has at least one deflectable wall portion for displacement into terminating engagement with the conductor core upon application of a force directed generally parallel to the longitudinal axis of the cable, whereby the cable can be both grounded and terminated in response to application of said forces.

5. In an electrical connector assembly as set forth in claim 1, wherein the connector housing is fabricated of dielectric material and includes a plurality of said receptacle cavities, and the improvement comprises a plurality of said preassembled modules adapted to be received in respective ones of the cavities.

6. In an electrical connector assembly as set forth in claim 1, including complementary interengaging locking means between the insert housing and the grounding terminal to retain the grounding terminal on the insert housing in preassembled condition.

7. In an electrical connector assembly as set forth in claim 1, wherein said insert housing is generally rectangular with first opposite side walls and second opposite side walls, said grounding terminal including spring contact portions outside the first opposite side walls and rigid portions outside the second opposite side walls.

8. In an electrical connector assembly as set forth in claim 7, including complementary interengaging locking means between the grounding terminal and the first opposite side walls of the housing to retain the grounding terminal on the housing in preassembled condition.

9. In an electrical connector assembly as set forth in claim 7, wherein the connector assembly includes a cover for closing said receptacle cavity, and said rigid portions of the grounding terminal include locking tabs for interengagement with the cover.

10. In an electrical connector assembly as set forth in claim 7, wherein said grounding terminal includes piercing means on said rigid portions for displacing the outer insulating jacket of the cable, the rigid portions including rigidifying ribs extending generally parallel to the longitudinal axis of the cable.

11. In an electrical connector assembly as set forth in claim 1, wherein the connector housing is fabricated of conductive material.

* * * * *